United States Patent [19]

Goggi

[11] Patent Number: 4,964,757

[45] Date of Patent: Oct. 23, 1990

[54] ECOLOGICAL PANEL FOR OBTAINING IN PARTICULAR BANK DEFENCES BY HINGING IT TO IDENTICAL PANELS

[76] Inventor: Francesco Goggi, Piazzetta Venco 4, 27045 Casteggio (Pavia), Italy

[21] Appl. No.: 390,200

[22] Filed: Aug. 7, 1989

[30] Foreign Application Priority Data

Sep. 16, 1988 [IT] Italy ..... 21984 A/88

[51] Int. Cl.[5] ..... E02B 3/06

[52] U.S. Cl. ..... 405/30; 405/15; 292/216

[58] Field of Search ..... 405/19, 20, 17, 15, 405/16; 403/330, 317, 49; 404/40, 36; 292/216

[56] References Cited

U.S. PATENT DOCUMENTS

| | | | |
|---|---|---|---|
| 518,754 | 4/1894 | Hall | 403/317 X |
| 1,148,915 | 8/1915 | McGillivray | 405/20 |
| 1,847,868 | 3/1932 | Everham | 405/20 |
| 2,876,628 | 3/1959 | Dixon | 405/20 |
| 3,386,252 | 6/1968 | Nelson | 404/40 X |
| 3,563,577 | 2/1971 | Wittenmayer | 292/216 X |
| 4,465,398 | 8/1984 | Knudsen | 405/20 X |
| 4,469,163 | 9/1984 | Klaucic | 403/330 X |
| 4,544,324 | 10/1985 | Hornung | 403/330 X |

FOREIGN PATENT DOCUMENTS

| | | | |
|---|---|---|---|
| 1534414 | 7/1969 | Fed. Rep. of Germany | 404/40 |
| 0757625 | 8/1980 | U.S.S.R. | 404/40 |

*Primary Examiner*—Dennis L. Taylor

*Attorney, Agent, or Firm*—Ladas & Parry

[57] ABSTRACT

The panel (1) is advantageously of prefabricated type and consists of a flat surface (2) provided with a plurality of horizontal slots (4) of any arrangement on the surface, and comprises hinges (5, 6) arranged to connect a plurality of the panels together in succession in a substantially vertical arrangement. The hinges are advantageously self-fitting and self-locking to allow rapid side-by-side connection of several panels without hindering their adaptation to any radius of curvature of the watercourse.

3 Claims, 2 Drawing Sheets

ECOLOGICAL PANEL FOR OBTAINING IN PARTICULAR BANK DEFENCES BY HINGING IT TO IDENTICAL PANELS

DESCRIPTION

This industrial invention patent relates to an ecological panel for obtaining in particular bank defences for streams and watercourses in general. Bank defences are currently formed by in-situ casting of continuous walls which although providing good structural resistance to overturning are negative in terms of drainage and the ecological growth of vegetation on the bank. A further drawback of the use of continuous walls as bank defences consists of the fact that their manual on-site construction is extremely slow and thus costly, because it is done in a difficult environment such as that represented by the bed of a watercourse. An object of the present invention is to provide a panel for constructing bank defences which is of such conformation as to be easily transported and mounted with the aid of special hinge joints which enable a barrier to be obtained which can be flexible in terms of its assembly and inclination and comprising slots which allow drainage of water from behind the bank, and also allow the growth of vegetation on the bank while preventing removal of material when the watercourses flood. This and further objects of the invention will be apparent to experts of the art on reading the following description and claims. The panel according to the invention is advantageously of prefabricated type and consists of a flat surface provided with a plurality of horizontal slots of any arrangement on said surface, and comprises hinge means arranged to connect a plurality of said panels together in succession in a substantially vertical arrangement. The hinge means are advantageously self-fitting and self-locking to allow rapid side-by-side connection of several panels and enable them to adapt to any radius of curvature of the watercourse.

The panel according to the invention is shown by way of non-limiting example on the figures of the accompanying drawing, in which.

Figure 4:
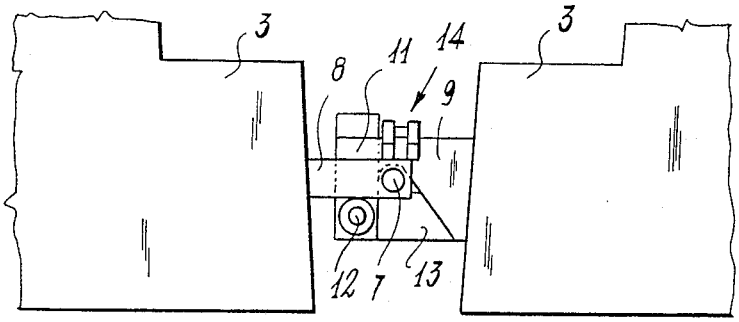
FIG. 4 is a plan view of a hinge.
Figure 5:
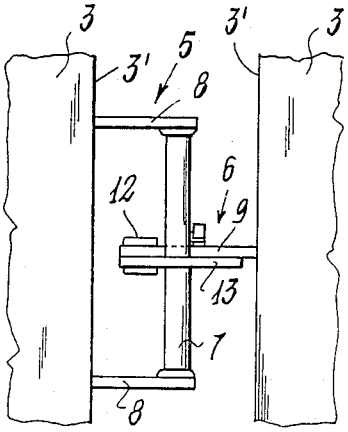
FIG. 5 is a front view of the hinge of FIG. 4.
Figure 7:
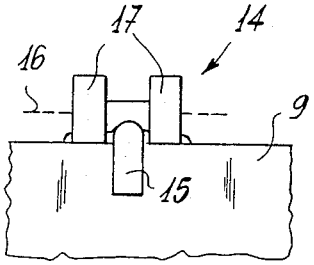
Figure 6:
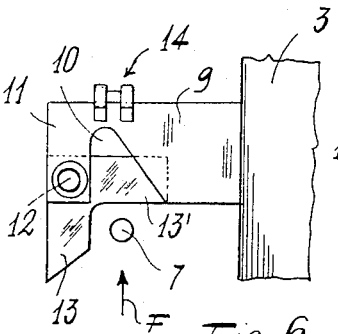
Figure 6A:
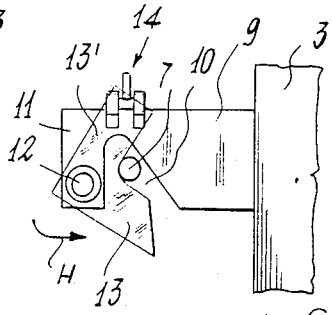
Figure 6B:
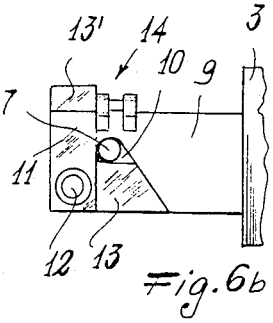

FIGS. 6, 6*a* and 6*b* diagrammatically illustrate the operation of the hinge of FIGS. 4 and 5; and FIG. 7 is an enlarged detail showing the locking member for the hinges.

Figure 1:
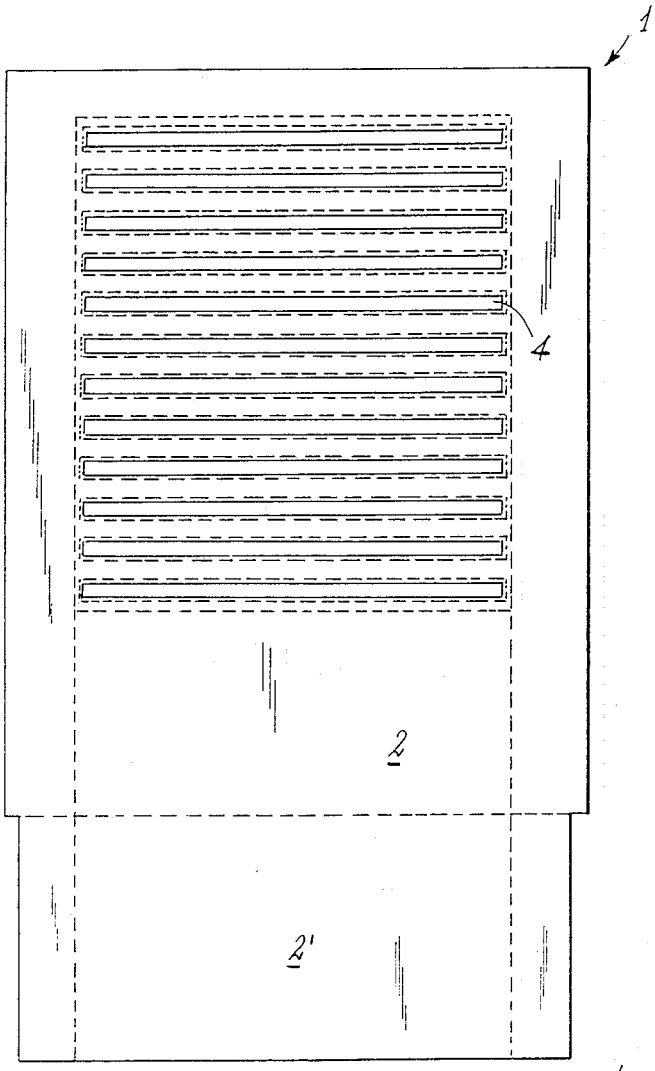
FIG. 1 is a front view of the panel, shown without the hinges for clarity.
Figure 2:
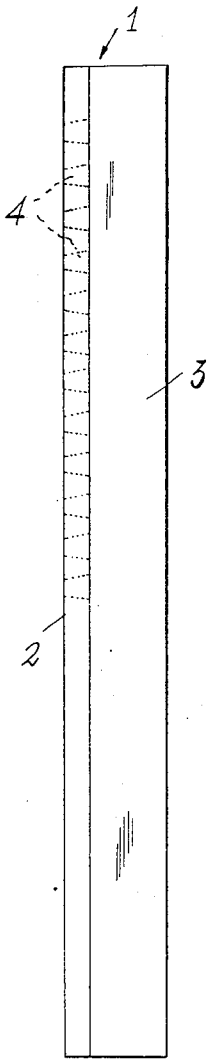
FIG. 2 is a side view of the panel of FIG. 1.
Figure 3:
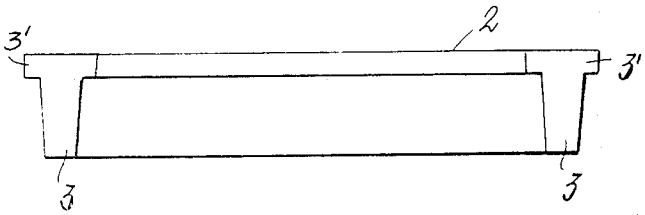
FIG. 3 is a plan view of the panel of FIG. 1.

With reference to said figures and in particular to FIGS. 1 to 3, the panel indicated overall by 1 comprises an advantageously prefabricated structure with a flat surface 2 laterally to which there are provided two pilaster strips 3 reinforced with non- or prestressed reinforcement. On the upper part of the surface 2, in practice starting from the predicted average water level, there is provided a plurality of horizontal slots 4 of cross-section in the shape of a trapezium with its minor frontal side facing outwards, i.e., towards the stream. This shape of cross-section means that the sliding effect of the stream which strikes said slots 4 creates marginal vortices on the surface and within the thickness of the panel to protect the interior of the structure from bank erosion. The lower part 2' of the panel 1 can form a support base on a suitable foundation, not shown. As can be seen specifically from FIGS. 4–7, on the opposing pilaster strips of two side-by-side panels 1 there are provided a number of vertically spaced-apart hinges each formed from a male part indicated overall in FIG. 5 by 5 and rigid with one pilaster strip, and a female part indicated in FIG. 5 by 6 and rigid with the opposing pilaster strip. The male part 5 consists of a vertical bar 7 fixed on the front 3' of the respective pilaster strip and kept spaced apart therefrom by anchored elements 8. The female part 6 consists of an element 9 fixed vertically on the front 3' of the respective pilaster strip and defining a wide V aperture 10 bounded by a dog 11 (see FIGS. 6, 6*a* and 6*b* in particular) on the free end of which there is pivoted at 12 a right angled element 13. A locking member (FIG. 7), indicated overall by 14, is fixed to the upper edge of the element 9 and comprises a pawl 15 pivoted on a pin 16 carried by brackets 17. With reference to FIGS. 6, 6*a*, 6*b* and 7, for the installation of a panel 1 it will be assumed that a first panel is already in position with the female part 6 of its hinges on the left (observing the panel from its outside) and the right-angled element 13 in the position shown in FIG. 6. Using a crane, another panel 1 with the male part 5 of its hinges on the right is moved towards the first panel (arrow F) so that the bars 7 act against the corresponding elements 13 to cause them to rotate (arrow H) about the pivot 12. During the rotation, the part 13' (FIG. 6*a*) lifts the pawl 15 of the member 14 and when the bar 7 is completely inserted in the aperture 10 (FIG. 6*b*) said pawl returns by simple gravity to the horizontal position to prevent the right-angled element 13 reopening. From the aforegoing it is apparent that the proposed embodiment enables the panels to be prepared in the factory and easily transported onto the site where they are to be installed. The particular conformation of the hinges allows very rapid fitting-together and in particular makes it possible to adapt the panels to any radius of curvature of the watercourse. As already stated the presence of the slots allows regular growth of vegetation on the bank, a growth which can be natural or guided by suitable sowing. The flat surface 2 of the panel can be completely smooth, rough or treated as required according to aesthetic and functional requirements.

I claim:

1. Prebabricated panels for preventing erosion of water banks, each said panel being comprised of:

a flat wall (2) having a plurality of horizontal slots (4), said slots being trapezium-shaped with the minor frontal side intended to face away from the bank and toward the water;

self-fitting, self-locking hinge means (5, 6), said hinge means comprising a male part (5) rigid with one panel and a female part (6) rigid with an adjacent panel, said male part comprising a vertical fixed bar (7) and said female part comprising a fixed element (9) on which a right-angled element (13) is pivoted (12), said fixed element having a wide V aperture (10) designed to receive said bar (7) of the male part, the purpose of said right-angled element (13) being to automatically lock said bar when said bar is inserted into said V aperture.

2. A panel as claimed in claim 1, characterised in that said hinge comprises a locking member (14) arranged to prevent the reopening of said right-angled element.

3. A panel as claimed in claim 2, characterised in that said locking member (14) comprises a pawl (15) which assumes its closure position by gravity.

* * * * *